US006471234B2

(12) United States Patent
Ayliffe

(10) Patent No.: US 6,471,234 B2
(45) Date of Patent: Oct. 29, 2002

(54) APPARATUS FOR AFFIXING CLIMBING SKINS TO SKIS

(75) Inventor: Harold Edward Ayliffe, 251 West 6th Avenue, North Vancouver, British Columbia (CA), V7M 1K7

(73) Assignee: Harold Edward Ayliffe, North Vancouver (CA)

( * ) Notice: Subject to any disclaimer, the term of this patent is extended or adjusted under 35 U.S.C. 154(b) by 43 days.

(21) Appl. No.: 09/770,948

(22) Filed: Jan. 26, 2001

(65) Prior Publication Data

US 2002/0101059 A1 Aug. 1, 2002

(51) Int. Cl.[7] ..... A63C 7/04; A63C 11/00; A44B 11/25

(52) U.S. Cl. ..... 280/604; 280/809; 24/265 R

(58) Field of Search ..... 280/809, 815, 280/636, 604, 605, 608, 609; 403/408.1, 315, 316, 317; 24/265 R, 265 EC

(56) References Cited

U.S. PATENT DOCUMENTS 1,783,833 A * 12/1930 Elsner ..... 280/809
2,287,252 A * 6/1942 Kaufmann ..... 280/809
2,358,213 A * 9/1944 Courage ..... 280/809
2,844,380 A * 7/1958 Tribblehorn ..... 280/809
3,582,101 A * 6/1971 Ste-Marie ..... 280/809
3,656,210 A * 4/1972 Parker et al. ..... 24/265 R
4,180,275 A * 12/1979 Montoya ..... 280/809
4,666,178 A * 5/1987 Matthews ..... 280/809
4,674,764 A * 6/1987 Miesen ..... 280/809
5,052,708 A * 10/1991 Matthews ..... 280/809
6,105,990 A * 8/2000 Sutherland ..... 280/604

* cited by examiner

*Primary Examiner*—Brian L. Johnson
*Assistant Examiner*—Jeffrey J. Restifo
(74) *Attorney, Agent, or Firm*—Michael A. Glenn

(57) ABSTRACT

A strap and climbing skin attachment assembly and kit having an elongated strap having a thickened end portion, two flat plates riveted to sandwich one end of the climbing skin, a rectangular cutout extending inward from the sandwiched end of the climbing skin between the plates, the unthickened end and body of the strap being insertable through an opening in at least one of the plates to thread the strap through the opening and between the plates until the strap is secured by the thickened opposite end engaging within the opening and in the cutout.

10 Claims, 6 Drawing Sheets

APPARATUS FOR AFFIXING CLIMBING SKINS TO SKIS

FIELD OF THE INVENTION

This invention relates to a system for securing a climbing skin to the bottom of a ski. In particular, the invention relates to an system for securing a climbing skin to one end of a resilient tensioning member used to affix the skin to a ski.

BACKGROUND OF THE INVENTION

Climbing skins have been used on skis for many, many years to assist skiers in ascending slopes. Original climbing skins were made from the skins of animals. More recently, climbing skins have been made from synthetic fabrics which have a nap of stiff, rearwardly angled fibres projecting from their bottom surfaces. When the skins are attached to the skis, the skis can be slid in a forward direction relatively easily. When the skis are moved in a rearward direction then the fibres bite into the snow. By attaching climbing skins to both skis, a skier can up even a reasonably steep snow slope by sliding one ski forward and then the other.

Attaching a climbing skin securely to the bottom of a ski in such a way that the climbing skin will not be easily dislodged during use and snow will not build up between the base of the ski and the climbing skin can be difficult. The problem of securely attaching climbing skins to skis is exacerbated by the fact that a skier my repeatedly put climbing skins onto skis and take them off during the course of a days skiing.

Early climbing skins simply had straps which were used to attach the climbing skin to the ski. Typically straps were provided to stretch the climbing skin between the tip and tail of the ski and additional straps were provided along the edges of the climbing skin. The additional straps could be used to tie the climbing skin to the ski itself. Such climbing skins tended not to work very well because it is generally not possible to tie the skin to a ski tightly enough to prevent snow from building up underneath the climbing skin. Furthermore, the numerous straps were time consuming to attach and keep properly adjusted.

More recently, adhesive climbing skins have been developed. Some adhesive climbing skins have a hook or the like which hooks over the tip of the ski. The skin is simply pressed against the ski base and is detachably held in place by a tacky adhesive. Such climbing skins provided acceptable performance when the base of the ski was dry. However, if the adhesive on the climbing skins becomes covered with snow or if the base of the ski becomes wet and has snow adhering to it then the adhesive may not properly hold the climbing skin to the base of the ski. In such cases, the climbing skin can become unstuck from the ski especially at the tail.

Climbing skins which use an adhesive as well as tail and tip straps to hold it in place have also become popular. This common tail fixation method is problematic in that it is usually necessary to modify the ski to provide a way to attach a strap to the tail end of the ski. Some current climbing skin systems have a fixture, such as a pin which is screwed into the top surface of the ski near the tail. A strap from the rear end of a climbing skin can then be stretched around the tail of the ski and attached to the pin. This is not desirable because it requires modification of the ski itself.

In another common tail fixation method, the skin is riveted to a pair of sandwiching metal plates that include an integral hook for engaging the tail end of the ski. Because the metal hook is relatively rigid, the strap must be moved to the tip end of the ski. Two rectangular metal wire looks (clips) are typically connected by a short (about 4 inches long) elastic, rubbery strip. The skin is fed through a portion of one of these separate clips and is looped back to adhere onto itself. The clip on the other end of the elastic strip is hooked over the tip of the ski to hold the skin in place. Having the elastic strip located at the tip can be a problem when the skier accidentally hits the wire loop with the opposite ski thereby knocking the clip completely off the tip of the ski. Once the skin is free from the tip of the ski, it can drag through the snow and the skin adhesive can become contaminated and eventually fail.

The straps, or elastic tensioning members, in strap-based skin attachment systems are usually made of plastic or rubber. These systems are prone to failure due to the harsh conditions they are exposed to. The plastic or rubber tensioning members can crack and tear in extreme cold. They are also subject to chemical breakdown through radiation exposure and oxidation. The metal plate and rivet systems used for fastening to the skin fabric can tear out of the comparatively weak fabric and are extremely difficult to replace in the field. Existing tip and tail systems have not directly addressed the long-term reliability issues and repair issues often-encountered in ski touring.

There is a need for an attachment system for climbing skins which allows climbing skins to be securely affixed by straps at both tip and tail ends of the ski and yet which is easy to use and does not require modification of the ski itself. There is also a need to provide an attachment system between the strap and the skin that is strong, does not tear the skin fabric and is field serviceable.

SUMMARY OF THE INVENTION

In one of its aspects the invention is an assembly for attaching an elongated resilient tensioning member to a climbing skin. The assembly comprises a generally rectangular cutout extending inward from one end of the skin, two flat rigid plates secured about opposite faces of the end of said skin by means of a plurality of rivets extending through apertures in the plates and through the skin. At least one of the plates has an opening therethrough. The tensioning member has an elongated body portion of substantially uniform thickness. One end portion of the member has a thickness greater than the thickness of the opposite end and than the body portion, and the end portion is no longer than the length of the opening. The end portion is retained in the opening between the plates and a portion of the tensioning member adjacent the end portion extends between the plates along the cutout.

In another aspect of the invention, the portion of the tensioning member that is adjacent the end portion is wider than the body portion and the width corresponds to the width of the cutout.

In another aspect of the invention, there are at least three rivets on at least three sides of the cutout.

In another aspect, the invention is a kit for a climbing skin system comprising an elongated climbing skin, a generally rectangular cutout extending inward from one end of the skin, two flat rigid plates secured about opposite faces of the end of the skin by means of a plurality of rivets extending through apertures in the plates and through the skin, with at least one of the plates having an opening therethrough. The kit also includes an elongated resilient tensioning member comprising an elongated body portion of substantially uniform thickness and two ends, a first of said ends having a end portion extending from said first end and having a thickness greater than the thickness of a second of said ends and greater than the thickness of said body portion, said end portion being no longer than the length of said opening.

In another aspect of the kit invention, a portion of the resilient tensioning member adjacent the end portion is wider than the body portion and the width corresponds to the width of the cutout.

In a further aspect of the invention, there are at least three rivets on at least three sides of said cutout.

Other aspects of the invention will be appreciated by reference to the detailed description which follows.

BRIEF DESCRIPTION OF THE DRAWINGS

In drawings which illustrate various non-limiting embodiments of the invention.

DETAILED DESCRIPTION OF THE PREFERRED EMBODIMENT

Figure 1:
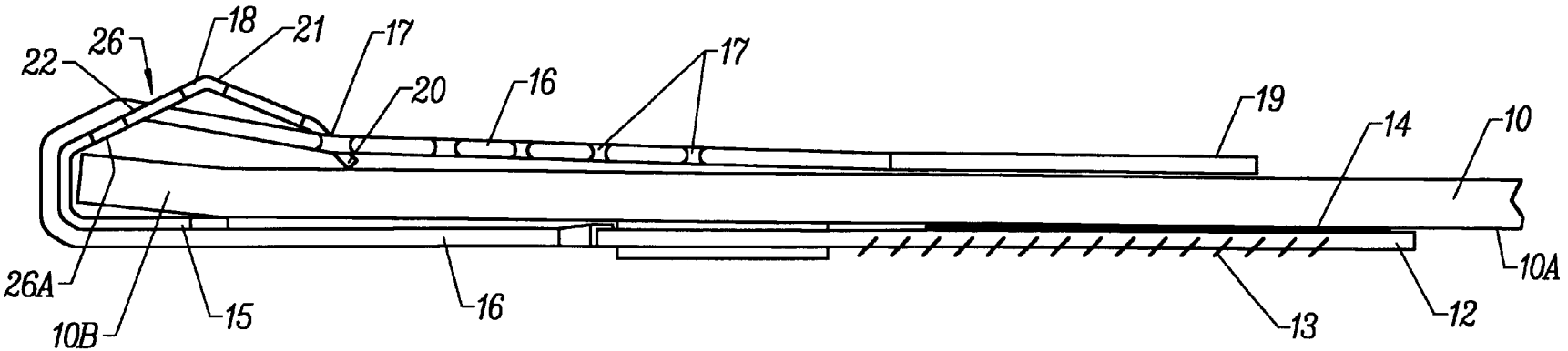
FIG. 1 is a section through a climbing skin mounting system on the rear of a ski.
Figure 2:
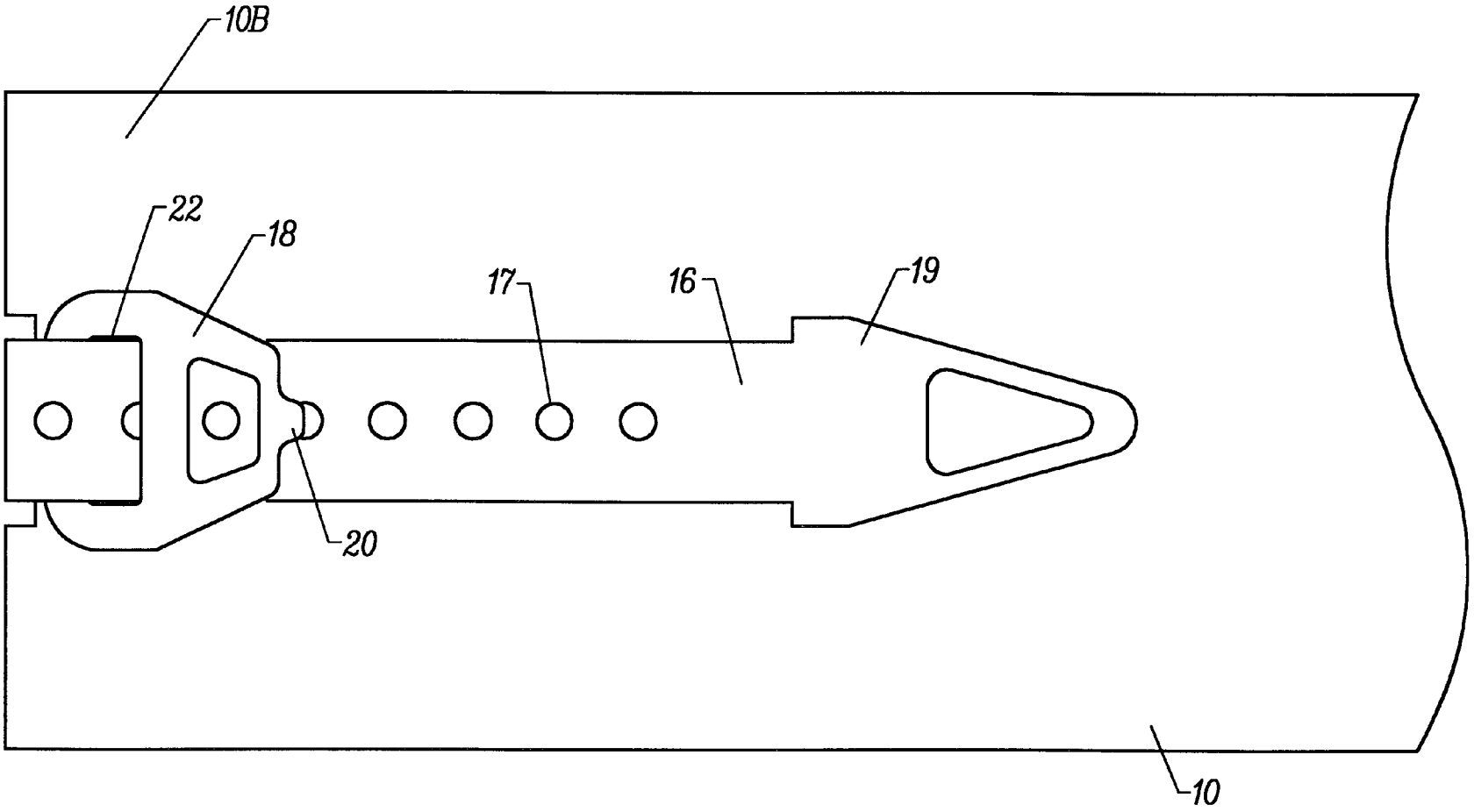
FIG. 2 is a top view thereof.

FIGS. 1 and 2 show a ski 10 to which is attached a climbing skin 12. Elongated climbing skin 12 has a nap 13 made of rearwardly angled bristles and is attached to the base 10A of ski 10 with a suitable removable adhesive 14. An elongated tensioning strap 16 is affixed to the rear end of skin 12 as discussed in greater detail below. Strap 16 is affixed at the tall 10B of ski 10 with a mounting clip 18.

Mounting clip 18 is very generally C-shaped in cross-section and hooks around the tail 10B of ski 10. Clip 18 has a low rigid flat portion 15 which extends underneath the base 10A of ski 10. Clip 18 is rigid so that it can slide onto tail 10B of ski 10 but cannot rotate when it is on ski 10. Strap 16 has a number of spaced apart apertures 17 in its distal portions. A user can apply tension to strap 16, pull strap 16 around the rear end of clip 18 and then hold strap 16 in place on clip 18 by hooking one of apertures 17 around a projecting pin 20 on clip 18

In the preferred embodiment shown in FIG. 1, clip 18 has a raised portion 21 in which is an aperture 22. Strap 16 passes through aperture 22. Thus, clip 18 remains on strap 16 even when skin 12 and strap 16 are removed from the ski 10. The shape of clip 18 tends to prevent clip 18 from rotating relative to tail 10B of ski 10 under the tension forces exerted on strap 16. Clip 18 may be made from any suitable material such as steel or a rigid plastic.

Preferably the rear portion 26 of clip 18 has a surface 26A which is disposed at an acute angle relative to base portion 15. Thus, when clip 18 is installed and strap 16 is under tension, the tail end 10B of ski 10 is wedged into the rear end of clip 18 between surface 26A and lower portion 15 of clip 18. This tends to prevent clip 18 from sliding sideways in either direction on the tail 10B of ski 10.

Preferably strap 16 and/or skin 12 are slightly resilient so that skin 12 and strap 16 remain under tension while in use. Strap 16 may be made from a strip of fabric-reinforced rubber, or the like. Most preferably, the rearmost end 19 of strap 16 is broadened. This both prevents the accidental removal of clip 18 from strap 16 and provides a convenient hand grip for applying tension to strap 16 when attaching skin 12 to a ski.

In the embodiment shown in FIGS. 1 and 2, the strap 16 is releasably affixed to clip 18 by means of a pin 20 on clip 18 which is received through an aperture 17 in strap 16. Other suitable means for holding the strap 16 is a tensioned manner to clip 18 may also be used.

For example, the clip may include a jam lever which can be pressed down so as to hold the strap in place on the clip by compressing a strap between a cam and a surface on the clip. Jam levers are known in the art and can be readily purchased from various sources. Preferably the jam lever is installed so that tension on strap tends to tighten the cam, and thereby prevent the strap from becoming loose during use.

Figure 3:
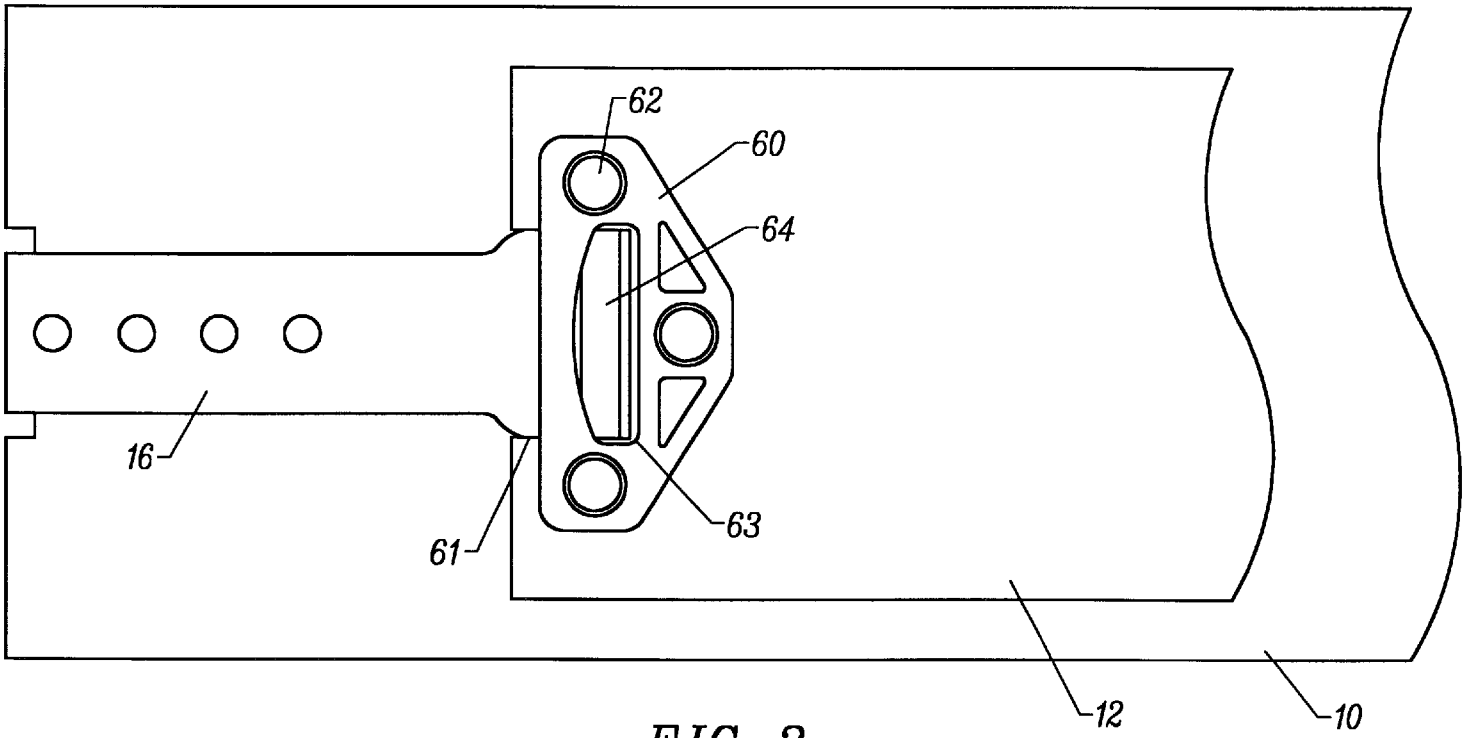
FIG. 3 is a bottom view of the tail end of the ski, showing an attachment assembly according to the invention for attaching the skin to the strap.
Figure 4:
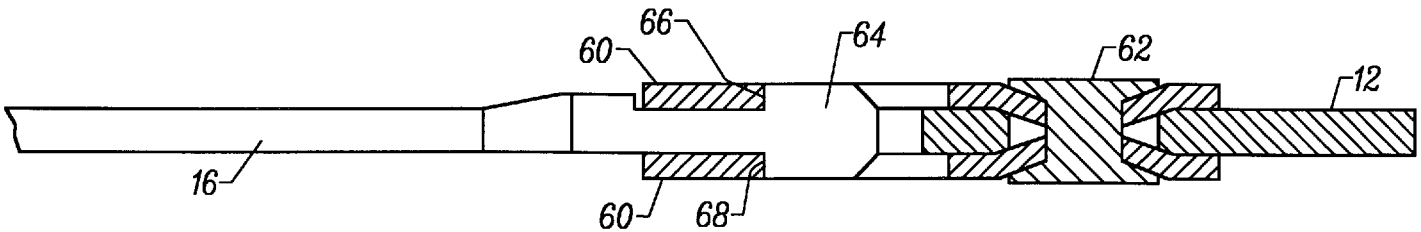
FIG. 4 is a cross sectional view of the skin, strap and attachment assembly according to the invention.

FIGS. 3 and 4 show a novel attachment means for connecting the resilient strap 16 to the climbing skin 12. In the preferred embodiment, two flat rigid plates 60, fabricated from steel or other suitable materials, are positioned on the two opposite sides or faces of the skin material so as to sandwich the skin material between them. A generally rectangular cutout 61 is made in the central portion of the tail end of the skin to make room for the strap 16, i.e. it extends inward from the tail end of the skin. Three holes are punched through the fabric to make room for the rivets 62. In the preferred embodiment, three soft, solid rivets 62 are deformed using a press or hammer to tightly squeeze the rigid plates 60 together, thereby securely pinching the skin fabric 12. Preferably the rivets are provided on at least three sides of the cutout 61 to maximize the integrity of the connection and to minimize fabric tear.

At least one of the two plates 60 includes an opening 63 that is sized to allow the clip end of strap 16 to be fed through opening 63 as will be explained below.

The end 64 of the strap that is adapted to be retained in the rivet assembly includes a thickened end portion, comprising opposed enlarged (thickened) sides 66, 68. The end portion is thicker than the elongated body portion of the strap 16 which has a substantially uniform thickness, and it is thicker than the opposite end of the strap. The thickened end portion is also preferably made no longer than the length of the opening 63 so as to allow it to be seated within the opening and the cutout in order to minimize its profile against the snow or the ski as the case may be.

Preferably the body of the strap 16 and the broadened clip end of the strap have a thickness of about 0.080 inches while the thickness through the combined raised portions 66, 68 of the strap is about 0.180 inches. It is contemplated that the combined thickness may range from 0.16 inches and 0.20 inches to achieve the objects of the invention.

The portion of the strap that is adjacent the thickened end portion is broadened to a width approximately equal to the width of the cutout 61. Once the plates 60 are assembled with the rivets 62, the strap 16 can be fed rearward, i.e. starting at its unthickened clip end, through the opening 63 in the plates 60. The strap 16 snaps into place and is help within the opening in the plates 60 by the dual opposing raised portions 66, 68 of the strap. The thickened end portion is then retained in opening 63 between the plates 60 and the broadened portion of the strap 16 that is adjacent the thickened end portion extends between the plates along the cutout 61. It will be appreciated that the strap and skin attachment assembly can be provided as a kit for assembly by the skier, comprising the skin one end of which is provided already sandwiched between the two plates and an elongated strap 16 as described above including the thickened end portion and preferably the broadened adjacent portion matching the width of the cutout.

The preferred embodiment of the strap and skin attachment assembly provides numerous advantages over the state-of-the-art skin technology. Primarily, the assembly allows for quick and easy replacement of strap 16 by the skier in the field. The skier simply slides a new strap into the plate opening 63. In addition, the strap 16 can be designed to have a breaking tension lower than the force required to pull or tear the plates 60 from the skin 12. The completed assembly is lightweight, thin, reliable, and easily field serviceable.

Alternatively, strap 16 could comprise a cord instead of a flat strap or could comprise a flexible flat member having, a cord attached to its end. Such a cord might be attached to a climbing skin by passing it around the rear end of the clip to be held in place by a cord lock device. Cord lock devices of various types are well known in the art. One type has a plug slidably mounted within a housing. The plug is biased toward one side of the housing by a spring. The cord passes through apertures in the housing and the plug and is jammed between the plug and the housing. A release button allows a user to displace the plug against the bias force exerted by the spring to release the cord. The cord lock device is preferably of a type which is designed in such a manner that tension on the cord tends to tighten the cord lock device.

Figure 5:
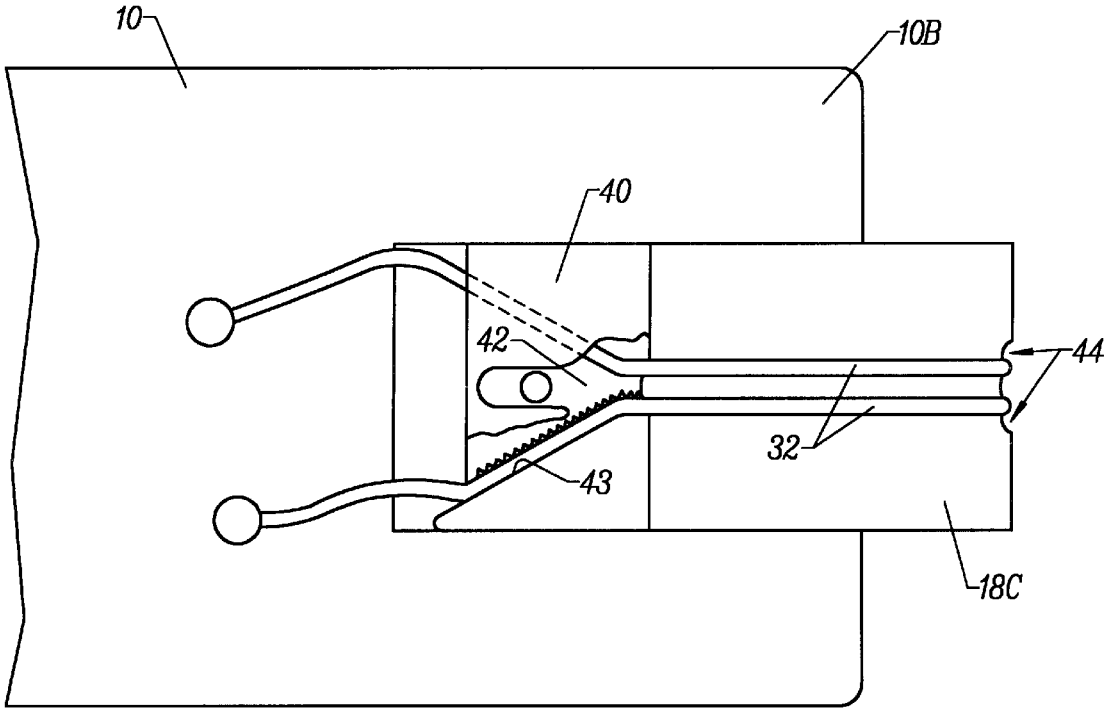
FIG. 5 is a schematic, partially cut-away top view of a mounting system according to an alternative embodiment which has a pair of cords held in a dual-cord cord lock.

FIG. 5 shows a clip 18C in which a skin 12 is tensioned on a ski 10 with a dual-cord cord lock 40. Cords 32 pass between a wedge 42 and inclined walls 43. Tension on cords 32 tends to pull wedge 43 rearwardly, thereby tightly gripping cords 32. The angles of walls 43 relative to the longitudinal center of clip 18C are exaggerated in FIG. 5. In the FIG. 5 embodiment cords 32 pass around locating grooves in the rear end of clip 18C. Locating grooves 44 guide cords 32.

Figure 6:
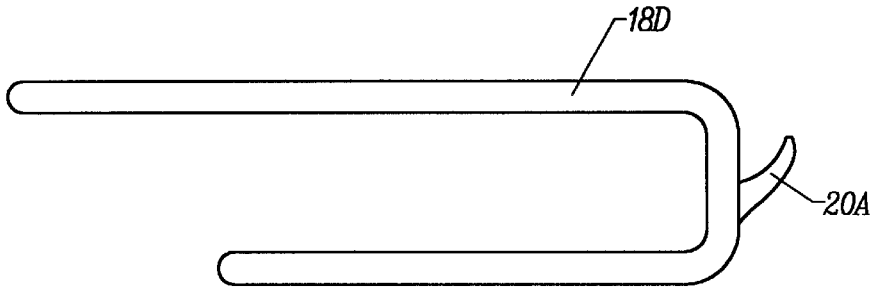
FIG. 6 is a side elevation of a clip having a pin projecting, from a location on its rear side

When a strap is affixed to a clip 16 by a way of a tab which projects through a hole in the strap, it is not necessary that the tab be located in the same position shown in FIGS. 1 and 2. FIG. 6 shows a clip 18D according to an alternative embodiment wherein a tab 20A projects generally rearwardly from clip 18. This embodiment is not preferable because of the enhanced likelihood that strap 16 may become accidently dislodged from tab 20A in the FIG. 6 embodiment during use.

Figure 7:
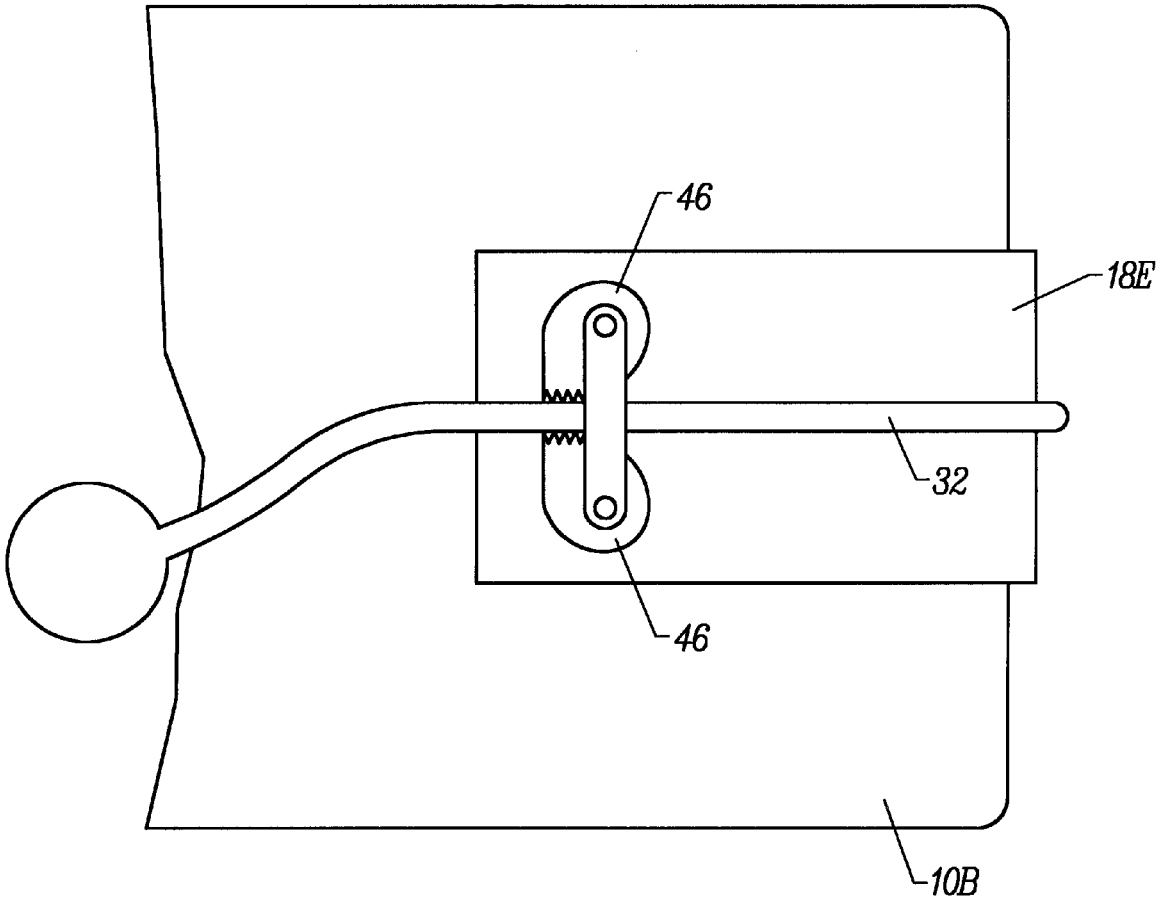
FIG. 7 is a top view of a further alternative embodiment wherein a cord is held between a pair of spring-loaded cams.

FIG. 7 shows a further alternative embodiment wherein a cord 32 which is attached to the rear end of a climbing skin passes around clip 18E and is held in place while tensioned between a pair spring-loaded cams 46. Larger versions of such cams are used, for example, to secure ropes on sailing boats.

Figure 8:
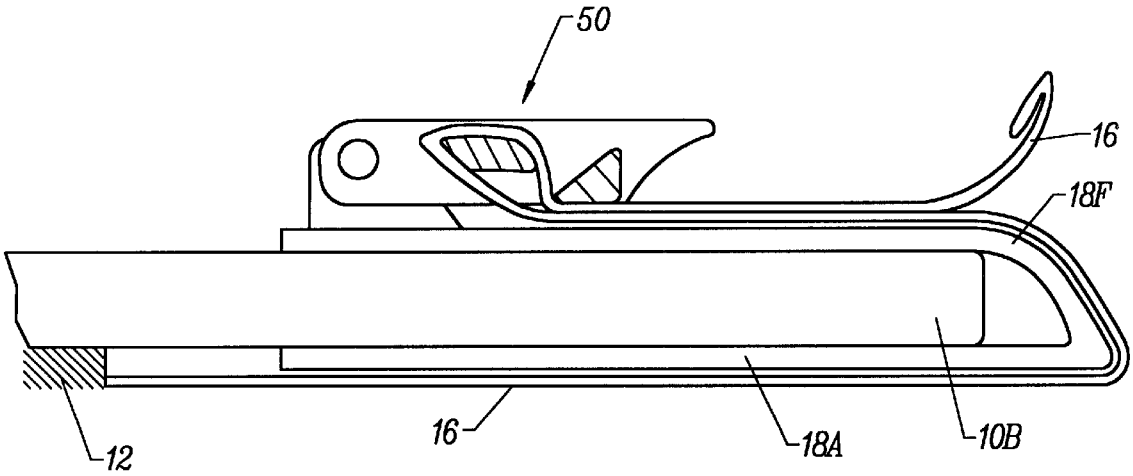
FIG. 8 is a section through a further alternative embodiment wherein a strap is held by a tension lock.

FIG. 8 shows a clip 18F according to a further alternative embodiment wherein a strap 16 is held in place by a tension lock assembly 50. Tension locks are well known and are commonly used to adjust the lengths of straps on backpacks. In a tension lock, a strap is doubled back on itself around a number of surfaces tending to resist slippage.

Figure 9:
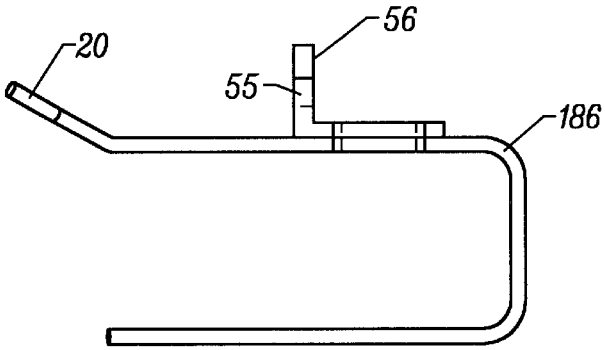
FIG. 9 is a side elevation of a clip according to an alternative embodiment wherein a strap passes through an upright flange on the clip.

As described above, in preferred embodiments the clip 18 is slidably disposed on the strap or cord which is attached to skin 12. This prevents clip 18 from becoming lost when skin 12 is detached from ski 10. The embodiment of FIGS. I and 2 shows the strap 16 passing through a pair slots on either side of a bend in the upper portion of clip 18. Clip 18 could be configured in any of various alternative ways which also cause clip 18 to be slidably disposed on a strap or cord when the skin is detached from a ski. For example, FIG. 9 shows a clip 18G wherein a strap or cord passes through an aperture 55 in a flange 56 which projects upwardly from a top surface of clip 1 8G. A strap or cord could also pass through a loop of cord or elastic attached to a clip 18.

While it is not preferred, a strap 16 could also be held to the top of clip 18 by a section of hook and loop fastener material such VELCRO™, having one part on the clip and another part on the strap. A strap or cord could also be retained on a clip 18 by a snap fastener, mechanical clamp, or the like. Where a mechanical clamp is used a user could pull a strap or cord tight and then secure the strap or cord in place by turning a screw or the like.

It will be appreciated that while the embodiments of the invention have been described in some detail, modifications and alterations thereto may be practiced without departing from the scope of the invention.

What is claimed is:

1. In a climbing skin assembly for a ski comprising a climbing skin and at least one elongated resilient tensioning member, an attachment assembly for securing said resilient tensioning member to said climbing skin, comprising:

a generally rectangular cutout extending inward from one end of said skin;

two flat rigid plates secured about opposite faces of said end of said skin by means of a plurality of rivets extending through apertures in said plates and through said skin;

at least one of said plates having an opening therethrough;

said elongated resilient tensioning member comprising an elongated body portion of substantially uniform thickness and two ends, a first of said ends having a end portion extending from said first end and having a thickness greater than the thickness of a second of said ends and greater than the thickness of said body portion, said end portion being no longer than the length of said opening; and, said end portion being retained in said opening between said plates and a portion of said resilient tensioning member adjacent said end portion extending between said plates along said cutout.

2. An attachment assembly as in claim 1 wherein said portion of said resilient tensioning member adjacent said end portion is wider than said body portion and said width corresponds to the width of said cutout.

3. An attachment assembly as in claim 1 or 2 wherein said plurality of rivets comprises at least three rivets on at least three sides of said cutout.

4. An attachment assembly as in claim 1 or 2 wherein the thickness of said end portion is between 0.16 and 0.20 inches.

5. An attachment assembly as in claim 1 or 2 wherein the thickness of said end portion is between 0.16 and 0.20 inches and wherein said plurality of rivets comprises at least three rivets on at least three sides of said cutout.

6. A kit for a climbing skin system comprising:

an elongated climbing skin;

a generally rectangular cutout extending inward from one end of said skin;

two flat rigid plates secured about opposite faces of said end of said skin by means of a plurality of rivets extending through apertures in said plates and through said skin;

at least one of said plates having an opening therethrough; and, an elongated resilient tensioning member comprising an elongated body portion of substantially uniform thickness and two ends, a first of said ends having a end portion extending from said first end and having a thickness greater than the thickness of a second of said ends and greater than the thickness of said body portion said end portion being no longer than the length of said opening.

7. A kit as in claim 6 wherein a portion of said resilient tensioning member adjacent said end portion is wider than said body portion and said width corresponds to the width of said cutout.

8. A kit as in claim 6 or 7 wherein said plurality of rivets comprises at least three rivets on at least three sides of said cutout.

9. A kit as in claim 6 or 7 wherein the thickness of said end portion is between 0.16 and 0.20 inches.

10. A kit as in claim 6 or 7 wherein the thickness of said end portion is between 0.16 and 0.20 inches and wherein said plurality of rivets comprises at least three rivets on at least three sides of said cutout.

* * * * *